US011697575B2

(12) United States Patent
Wilson

(10) Patent No.: US 11,697,575 B2
(45) Date of Patent: Jul. 11, 2023

(54) STAIRLIFTS

(71) Applicant: Stannah Stairlifts Limited, Hampshire (GB)

(72) Inventor: Alexander Henry Gage Wilson, Hampshire (GB)

(73) Assignee: STANNAH STAIRLIFTS LIMITED, Hampshire (GB)

( * ) Notice: Subject to any disclaimer, the term of this patent is extended or adjusted under 35 U.S.C. 154(b) by 291 days.

(21) Appl. No.: 17/266,067

(22) PCT Filed: Aug. 6, 2019

(86) PCT No.: PCT/GB2019/052198

§ 371 (c)(1),
(2) Date: Feb. 4, 2021

(87) PCT Pub. No.: WO2020/030899

PCT Pub. Date: Feb. 13, 2020

(65) Prior Publication Data

US 2021/0253399 A1 Aug. 19, 2021

(30) Foreign Application Priority Data

Aug. 6, 2018 (GB) ..... 1812722

(51) Int. Cl.

| | |
|---|---|
| ***B66B 9/08*** | (2006.01) |
| ***B66B 5/00*** | (2006.01) |
| *B66B 5/02* | (2006.01) |

(52) U.S. Cl.
CPC ..... *B66B 9/08* (2013.01); *B66B 5/0031* (2013.01); *B66B 5/02* (2013.01)

(58) Field of Classification Search
CPC ..... B66B 9/08; B66B 5/0031; B66B 5/02
See application file for complete search history.

(56) References Cited

U.S. PATENT DOCUMENTS

| | | | | |
|---|---|---|---|---|
| 9,457,992 | B2 * | 10/2016 | Ooms | B66B 9/08 |
| 11,059,696 | B2 * | 7/2021 | Kasbergen | B66B 1/3461 |
| 2008/0128213 | A1 * | 6/2008 | Harris | B66B 9/0846 187/289 |
| 2008/0268831 | A1 * | 10/2008 | Hall | B66B 5/0031 455/424 |
| 2010/0314201 | A1 * | 12/2010 | Stannah | B66B 9/0853 187/201 |
| 2014/0326540 | A1 * | 11/2014 | Ooms | B66B 9/08 187/201 |
| 2016/0237690 | A1 * | 8/2016 | Hyde | E04F 11/1863 |

(Continued)

FOREIGN PATENT DOCUMENTS

| | | |
|---|---|---|
| CN | 107117512 A | 9/2017 |
| CN | 107140504 A | 9/2017 |

(Continued)

OTHER PUBLICATIONS

International Search Report dated Oct. 22, 2019; International Application No. PCT/GB2019/052198.

(Continued)

*Primary Examiner* — Michael A Riegelman
(74) *Attorney, Agent, or Firm* — Dinsmore & Shohl LLP

(57) ABSTRACT

A stairlift is configured to assist users by issuing voice-based messages in the event faults arise that could give concern to a user.

18 Claims, 1 Drawing Sheet

(56) References Cited

U.S. PATENT DOCUMENTS

| | | | | |
|---|---|---|---|---|
| 2017/0337796 | A1* | 11/2017 | Helal | G08B 21/0492 |
| 2019/0047825 | A1* | 2/2019 | Jakes | B66B 9/08 |
| 2019/0382243 | A1* | 12/2019 | van Eijgen | B66B 9/08 |
| 2020/0165103 | A1* | 5/2020 | Titchener | B66B 9/08 |
| 2020/0198928 | A1* | 6/2020 | Kasbergen | B66B 5/0006 |
| 2020/0283262 | A1* | 9/2020 | Piper | B66B 9/08 |
| 2021/0087019 | A1* | 3/2021 | Chida | B66B 9/0815 |
| 2021/0163263 | A1* | 6/2021 | Boxum | B66B 9/08 |
| 2021/0253399 | A1* | 8/2021 | Wilson | B66B 9/08 |
| 2021/0347606 | A1* | 11/2021 | Wilson | B66B 9/0807 |
| 2022/0315386 | A1* | 10/2022 | Lampe | H02J 7/0042 |

FOREIGN PATENT DOCUMENTS

| | | | |
|---|---|---|---|
| EP | 1938048 | A1 | 7/2008 |
| GB | 2463734 | A | 3/2010 |
| GB | 2491553 | A | 12/2012 |
| GB | 2542822 | A | 4/2017 |
| JP | 2003191838 | A | 7/2003 |
| JP | 2010070341 | A | 4/2010 |
| WO | 2013095110 | A1 | 6/2013 |

OTHER PUBLICATIONS

German Search Report dated Jan. 27, 2019; German Application No. GB1812722.5.

* cited by examiner

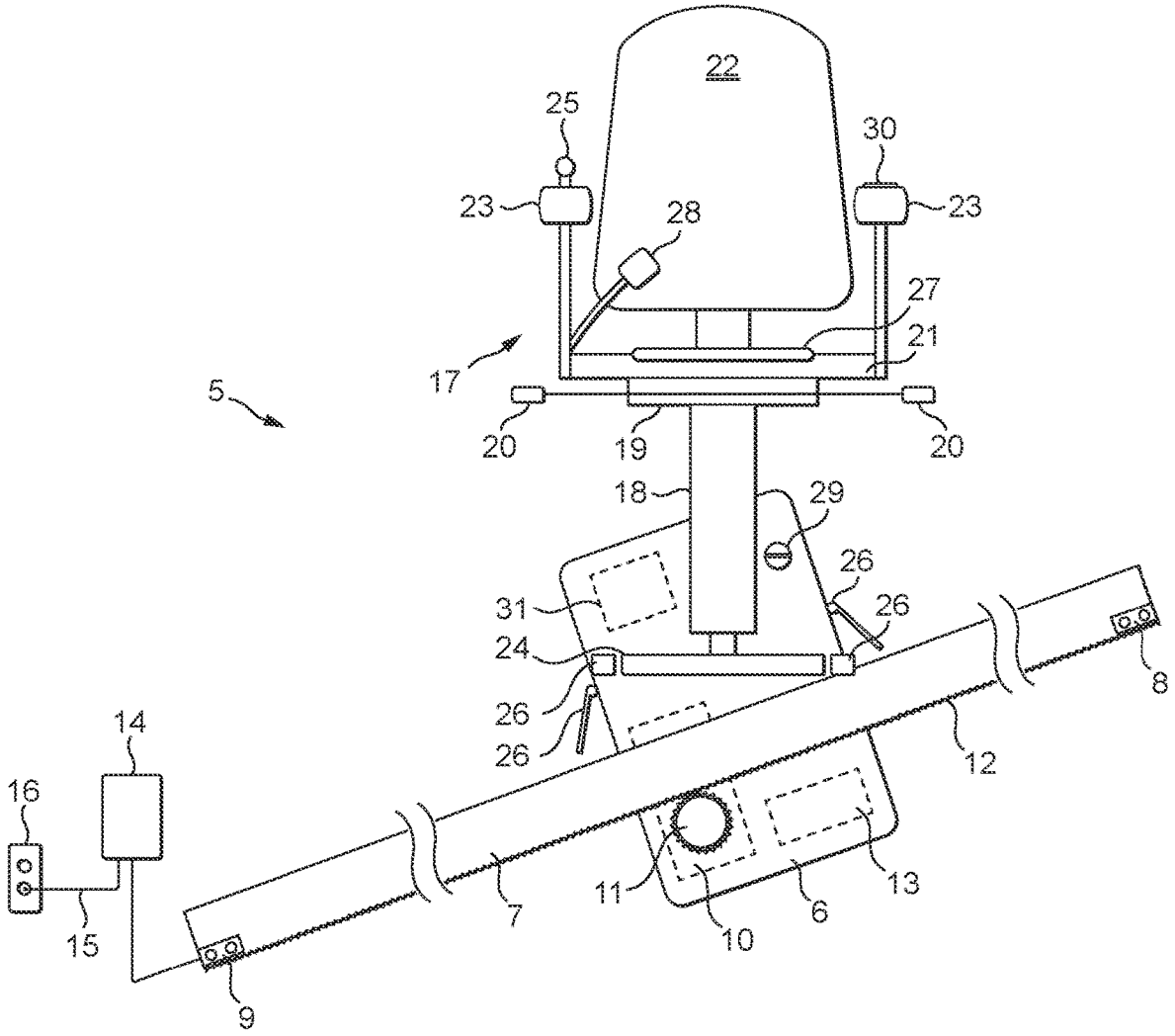
22
25
30
23
23
28
27
21
17
5
20
19
20
18
29
26
31
26
24
26
26
8
14
12
16
11
13
7
6
15
10
9

STAIRLIFTS

CROSS REFERENCE TO RELATED APPLICATIONS

This application is the U.S. national stage of PCT/GB2019/052198 filed Aug. 6, 2019, which claims priority of United Kingdom patent application 1812722.5 filed Aug. 6, 2018, both of which are hereby incorporated by reference in their entirety.

FIELD OF THE INVENTION

This invention relates to stairlifts and, in particular, to a stairlift having a facility for improving interaction with a stairlift user.

BACKGROUND TO THE INVENTION

A stairlift is a safety-critical apparatus used by persons having at least some degree of disability. As with all mechanical and electro-mechanical devices a stairlift is susceptible to malfunction and, given the potential limitations of some stairlift users, considerable effort is applied to ensure that users are not exposed to unnecessary danger when a malfunction occurs. Further, when a fault does occur, it is important that the fault is quickly identified and addressed.

It is known to provide a visual display on the stairlift in which codes representative of particular faults are displayed but these are principally for the benefit of technicians or service centres responsible for the servicing or upkeep of the stairlift, and are of no immediate assistance to a stairlift user. In our experience, typical stairlift users, and persons having limited technical understanding, find the observation and interpretation of fault codes difficult and confusing.

An advance on the mere display of fault codes is described in European Patent 1 938 048 in which a stairlift is provided with a facility to monitor the operation of the stairlift, to sense a fault, and to communicate the nature of a fault to a remote service centre by way of an SMS message. Again this system is of assistance to service providers but provides no immediate assistance to a stairlift user.

The occurrence of faults is one issue but in some instances what a user perceives to be a fault is not, in fact, a fault. For example, a user may board the stairlift, operate the hand control to start the carriage moving along the rail, only to find that the carriage does not move. This may be indicative of a fault but experience indicates that, in many instances, the problem arises because one of the isolating switches is in the off position. A further example is when a user unwittingly releases pressure on the hand control mid-journey causing the carriage to come to a halt at some point along the rail, spaced from the ends. There have been instances where the user interprets this event as the onset of a fault, does not re-activate the hand control, and attempts to dismount the stairlift. This can be extremely dangerous as any attempt to dismount the stairlift mid-journey exposes the user to the possibility of a dangerous fall.

It is an object of the present invention to provide a stairlift, that will go at least some way to addressing the aforementioned drawbacks; or which will at least provide a novel and useful choice.

SUMMARY OF THE INVENTION

Accordingly, the invention provides a stairlift including a rail; a carriage displaceable along said rail; a user control displaceable by a user to effect movement of said carriage along said rail; and a diagnostic facility configured to detect faults arising in the operation of the stairlift, wherein said diagnostic facility is further configured to identify the nature of a fault and to issue to a stairlift user a voice-based output in response to that fault.

Preferably said voice-based outputs comprise suggestions or instructions to aid a user in responding to a detected fault.

Preferably said diagnostic facility is configured to delay issuing a voice-based output for a defined period following a detection of a fault.

Preferably said defined period varies according to the nature of the detected fault.

Preferably one voice-based output is linked with a further voice-based output a non-verbal audio output and/or a haptic output.

Preferably said voice-based output comprises an instruction to the user relating to operation of the user control.

Preferably said stairlift includes an upper stop point at an upper end of the rail and a lower stop point at a lower end of the rail, wherein a fault comprises the carriage coming to a halt between said upper stop point and said lower stop point in response to said user control assuming an off position, and wherein said diagnostic facility is configured to issue a voice-based output comprising an instruction to a user to displace the user control into an operating position to effect movement of said carriage toward a stop point.

Preferably said diagnostic facility is further configured to issue a voice-based output comprising an instruction to a user not to dismount from the stairlift until arrival at a stop point.

Preferably said stairlift further includes a chair occupancy sensor and wherein said diagnostic facility is configured to issue an instruction to a user not to dismount from the stairlift in response to a signal from said chair occupancy sensor.

Preferably a fault comprises the carriage failing to move or coming to a halt while the user control is in an operating position, and wherein said diagnostic facility is configured to issue a voice-based output comprising an instruction to a user to communicate with a help provider.

Preferably said diagnostic facility is further configured to issue a voice-based output comprising an instruction to a user of a procedure to dismount from the stairlift.

Preferably said stairlift includes safety edges displaceable in the event said carriage encounters an obstruction while moving along said rail, wherein a fault comprises the carriage failing to move or coming to a halt while said user control is in an operating position and a safety pad is displaced by contact with an obstruction, and wherein said diagnostic facility is configured to issue a voice-based output comprising an instruction to remove an obstruction to thereby release the safety pad; or to drive the carriage in a reverse direction away from the obstruction.

Preferably said stairlift includes one or more of a carriage isolation switch, a bi-stable switch and a key switch, each of said switches having an 'on' position and an 'off' position, any of said switches when in an off position preventing said carriage from movement along the rail, wherein a fault comprises a switch being in an off position while said user control is displaced to an operating position, and wherein said diagnostic facility is configured to issue a voice-based output instructing a user to displace said switch to an 'on' position.

Preferably said diagnostic facility is further configured to issue a voice-based output directing a user to a location of a switch, the position of which is preventing movement of said carriage.

Preferably said diagnostic facility includes an input representative of a voltage level of a battery provided to power said carriage along said rail, and wherein a fault comprises said voltage level being below a target voltage level when said user control is in an operating position, said diagnostic facility being configured to issue voice-based output instructing a user to displace the user control to drive the carriage to a charging point on said rail.

Preferably said stairlift further includes a battery charger operable to charge one or more batteries within said carriage and said diagnostic facility includes an input representative of the operation of said charger, wherein a fault comprises no charging power being sensed when said carriage is parked on a charging point on said rail, and wherein said diagnostic facility is configured to issue voice-based output instructing a user to check the connection of said charger to mains power.

Preferably said stairlift further includes a swivel mechanism between said chair and said carriage operable to enable said chair to be swivelled between a central travel position and a swivelled position when said carriage is at a said stop point, wherein a fault comprises said user control being displaced into an 20 operating position when said chair is in a position other than the central position, and wherein said diagnostic facility is configured to issue a voice-based output instructing a user to move the chair to the central position.

Preferably said stairlift further includes a seatbelt operable to retain a user in the chair, said seatbelt having a fastened and an unfastened state, wherein a fault comprises said hand control being displaced into an operating position while said seat belt is in an unfastened state, wherein said diagnostic facility is configured to issue a voice-based message instructing a user to move the seatbelt into a fastened state.

Preferably said diagnostic facility is further configured to issue a non-verbal audible sound characteristic of the presence of a fault.

Preferably said diagnostic facility is configured to receive communications from a remote communication device including a mobile telephone, tablet or other and to issue voice-based outputs in response to communications from said remote communication device.

Preferably said diagnostic facility is configured such that one or more of the tone, volume and frequency of voice-based outputs are adapted to the needs or wishes of a user and/or said diagnostic facility is configured to receive operating upgrades from a remote location.

Many variations in the way the present invention can be performed will present themselves to those skilled in the art. The description which follows is intended as an illustration only of one means of performing the invention and the lack of description of variants or equivalents should not be regarded as limiting. Subject to the scope of the appended claims, wherever possible, a description of a specific element should be deemed to include any and all equivalents thereof whether in existence now or in the future.

BRIEF DESCRIPTION OF THE DRAWING

One working embodiment of the invention will now be described with reference to the accompanying drawing in which FIG. 1 shows a stairlift in diagrammatic form to which the present invention may be applied.

DETAILED DESCRIPTION OF WORKING EMBODIMENT

FIG. 1 shows a stairlift to which the present invention may be applied either in whole or in part. Further, subject to the scope of the appended claims, further voice-based outputs not presently described may be provided without departing from the scope of this invention.

In the example shown the stairlift 5 comprises a carriage 6 mounted on rail 7 for movement on the carriage between an upper stop point 8 and a lower stop point 9. The carriage 6 is driven along the rail by an electric motor 10 rotating a pinion 11 which engages with a rack 12 extending along the underside of the rail. The motor 10 draws its operating power from one or more batteries 13 mounted in the carriage 6, the batteries 13 being charged from battery charger 14 and charging connections typically included in, or mounted at, the stop points 8 and 9. The charger 14 may be connected to mains supply by cable 15 connected into wall socket 16.

In the conventional manner a chair 17 is mounted on the carriage 6 by way of an interface 18 and, in this example, a swivel mechanism 19 operated by paddle levers 20. The chair comprises a seat base 21, backrest 22 and spaced armrests 23. A footrest 24 is mounted on the lower edge of the interface 18. A hand control 25 is mounted on one of the armrests 23 whereby a user can control the movement of the carriage up and down the rail. As typically encountered a user control, preferably a hand control 25, has an off position and an operating position, an internal spring bias causing the hand control to assume the off position when a user releases pressure from the hand control when in an operating position.

The user control is typically supplemented by landing controls (not shown) whereby the stairlift can be called from a one landing when it is parked at another landing. Safety pads 26 are provided on the carriage and preferably on the footrest 24 which, in the event an obstruction is encountered as the carriage moves along the rail, displace and trigger switches to bring the carriage to a halt. In this particular example an occupancy sensor in the form of a pressure sensitive pad 27 is provided in the seat base 21 and, in the known manner, the chair is also provided with a seatbelt 28 to retain a user in the chair during travel.

In order to prevent unauthorized use of the stairlift and/or to preserve battery charge a number of switches are provided on the stairlift. These may comprise an isolation switch or child lock 29 and a bi-stable on/off switch 30. The isolation switch 29 is preferably a key switch.

The functioning of the stairlift is preferably under the control of electronic control unit (ECU) 31. The ECU 31 receives inputs from the hand control 25, the safety pads 26, the swivel mechanism 19, the charging points at stops 8 and 9, the batteries 13, seat belt 28 and the switches 29 and 30. In accordance with the invention a diagnostic facility is provided, preferably within ECU 31, the diagnostic facility being configured to issue a plurality of voice-based instructions related to a corresponding plurality of faults that might arise during operation. In this context a fault may be an internal or hard fault in a component of the stairlift, or may be a fault due to an operating error by a user. As will be described in greater detail below, should a fault arise the ECU then outputs a voice-based instruction to a user to direct the user to action that may mitigate the effects of the fault. By way of example, the voice-based messages may take the form of pre-recorded messages or may be generated using a voice synthesizer.

In this context reference to the ECU or diagnostic facility issuing, emitting or outputting signals and voice-based messages should be interpreted as including the ECU or diagnostic facility causing signals or messages to be issued, emitted or outputted since the messages may be stored or created by a separate unit, albeit a unit responding to commands from the ECU 31.

The ECU 31 is preferably configured to apply a short delay, for example 1 to 10 seconds, before outputting the voice-based instruction. This delay may vary according to the nature of the fault arising. The voice-based message may be preceded by a non-verbal audible sound and/or a haptic output indicating that a fault has arisen that requires the attention of the user, thereby alerting the user to listen for a voice-based instruction.

Examples of faults may include, (but not be limited to):

1) The carriage 6 stopping on the rail 7 between stop points 8 and 9 with the hand control 25 released (in the 'off' position).
2) A user attempting to dismount the stairlift with the carriage 6 at a position on the rail between stop points 8 and 9.
3) The carriage 6 encountering an obstruction (a safety pad 26 being displaced) during travel or at the start of a journey.
4) A fault arising in the stairlift pre-travel.
5) A fault arising in the stairlift during travel.
6) The carriage failing to respond to the hand control 25 because switch 29 is in the 'off' position.
7) The carriage failing to respond to the hand control 25 because bi-stable switch 30 is in the 'off' position.
8) A charging current is not flowing when the carriage is parked at a stop point 8 or 9.
9) The voltage of batteries 13 is below a predetermined voltage.
10) The swivel 19 is not centered when the hand control 25 is displaced into an 'on' position.
11) The seatbelt 28 is not fastened when the hand control 25 is displaced into an 'on' position.
12) The stairlift does not respond to the hand control when the seat base 21 is unloaded and/or one of the armrests 23 is in the folded or 'up' position.

Further, as will be illustrated below, the ECU may be configured to provide layers of outputs. In other words, a first fault may give rise to a first verbal output that elicits a first response from a user. Depending on the response made by the user, or the state in which the stairlift is then placed, the ECU may determine the presence of a second fault that gives rise to a second verbal output. One example of this is illustrated in Operating State 2 described below.

Each of the above states may, though not necessarily exactly as described, be addressed as follows:

Operating State 1

Carriage 6 comes to a halt before arriving at a stop point 8 or 9 as a result of a user releasing hand control 25 thus allowing the hand control to assume an 'off' position.

After 5 seconds of no input from the hand control or from a landing control the ECU 31 issues a voice-based message such as:

"You have let go of the arm control. Please move and hold the arm control in the direction you wish to travel until we reach the arrival point."

Operating State 2

The carriage 6 is not positioned at a rail end at a stop point 8 or 9 and a user tries to stand as sensed, for example, by the release of loading on pressure pad 27.

The ECU issues a voice-based instruction such as:

"We're not there yet, please remain seated and travel to the arrival point."

Once the user is seated again as sensed by the pressure pad 27, operating state 1 is again assumed and, if the hand control has not then been displaced after the stated delay, a further instruction as in Operating State 1 is given.

Operating State 3

A safety pad 26 is activated (displaced). This may arise when the carriage is moving along the rail or when the carriage is halted and the hand control 25 is displaced to an 'on' position to initiate movement. The control doesn't need to be released for the instruction to start.

As a first step the ECU emits an audible signal indicating an error or the presence of an event requiring attention. After, say, a 1 second delay the ECU 5 then issues a voice-based instruction such as:

"An object is blocking my way, please remove it if safe to do so, or travel the other way."

Operating State 4

The stairlift will not operate when the carriage is at rest and hand control 25 is 10 operated, due to a hard fault; a fault that a user cannot resolve.

Upon the control 25 or a landing control being moved to an 'on' position the ECU will emit an audible error sound followed by a voice-based instruction such as:

"Sorry, I need some assistance. Please contact your supplier. You can do this 15 using your mobile application or by using the telephone number written on the side of your carriage."

Operating State 5

The stairlift stops during travel with the hand control 25 in an 'on' position, due to hard fault; a fault that a user cannot resolve.

Upon stopping the ECU 31 emits an audible error sound followed by a voice-based instruction such as:

"Sorry, I'm experiencing an issue and have stopped working. Ask another person in the house to assist you dismount if possible. If not, use the swivel lever to your side and swivel the chair towards the staircase, dismount with care then contact your supplier to inform them about this issue."

If chair is still in the travel or central position after 30 seconds, the ECU issues a further voice-based instruction such as:

"Swivel the chair towards the staircase using the lever to your side. I have stopped working and you will need to raise help or dismount."

The last instruction can be repeated until the ECU receives an input that the swivel 19 has been moved from the centre position and the seat pad 27 is unloaded.

Operating State 6

Isolation switch 29 on carriage is in the 'off' position; the carriage will not move.

Upon the hand control 25 being moved to an 'on' position, or a call being made from a landing control, the ECU emits an audible error sound followed by a voice-based message such as:

"You have put me in isolation mode. Please press the power button on the back of the carriage to reactivate."

Operating State 7

Bi-stable switch 30 is in off position; carriage will not respond to an input from the hand control 25, or from a call made from a landing control.

Upon the hand control 25 being moved to an 'on' position, or a call being made from a landing control the ECU emits an audible error sound followed by a voice-based message such as:

"You have put me in isolation mode. Please press the power button on the arm rest to reactivate."

Operating State 8

No charging current is flowing to the carriage 6 when parked at a stop point 8 or 9.

After a delay of, say, 5 seconds after carriage reaches a stop point, the ECU emits an audible error sound followed by voice-based instruction to issue such as:

"Sorry, my charger needs assistance. Please make sure I'm plugged in and the wall socket is switched on to avoid low battery."

This message may be repeated at defined intervals of, say, 1 minute if the operating state persists.

Operating State 9

The battery voltage falls below a specified minimum voltage when the hand control 25 is displaced to an 'on' position, or the battery voltage is already below the specified target level when the hand control is activated.

The ECU emits an audible error sound and then, if the hand control is not released after, say, 10 seconds a voice-based instruction issues such as:

"My batteries are low, please travel downstairs and allow me to recharge."

In this state the stairlift will not respond to a call or command for the carriage to move in an uphill direction. The error sound and above message will be repeated.

On arrival at a stop point the ECU issues a voice-based message such as:

"Thank you, I'm now recharging please contact your supplier to inform them about this issue."

Operating State 10

The stairlift does not respond to the hand control 25 because the chair 17 is not locked in a travel position. Typically the travel position is a central position of the swivel mechanism 19.

In this instance, when the hand control 25 is displaced into an 'on' position the ECU will emit an audible error sound followed by a voice-based instruction such as:

"Please make sure the chair is in the travel position by using the levers to your sides. Rotate the chair towards the stairs until it reaches the stop, then release the levers."

Operating State 11.

The chair 17 is fitted with interlock seat belt 28 and seat belt is not secured when the hand control 25 is displaced to an 'on' position.

The ECU emits an audible error signal followed, after a short delay, by a voice-based message such as:

"Please fasten your seatbelt."

Operating State 12

The stairlift does not respond to the hand control 25 when no load is sensed by the pressure pad 27 or when an armrest is in a folded (up) position.

The ECU emits an audible error signal followed, after a short delay, by a voice-based message such as:

"Please make sure you are seated and both arm rests are in the down position."

The instruction is repeated if the problem continues for a specified period of time.

In addition to providing the diagnostic facility described above, the ECU 31 is preferably configured to communicate with one or more remote communication devices such as, for example, a mobile phone, tablet computer or other computing device. When so configured, the diagnostic facility may be modified or updated but also, communications may be transferred from remote sites to a user. Examples of voice-based messages that can be issued following an external communication can include:

A message that help is on the way

A message that a caller is at the door

News updates, and other information from sources such as Google

In conjunction with a proximity sensor, such as described in our European Patent 1 648 810, a greeting message such as "Good Morning" which also provides a degree of comfort to a user that the stairlift is operating correctly.

Different commands and/or coaching not necessarily related directly to the functioning of the stairlift may also be provided.

The control facility can also be configured to act in a two-way manner and be provided with a microphone so that a user may send voice-based messages.

The control facility is preferably configured to allow customization to a user's needs or wants. For example, the voice output may be adapted to reflect gender, ethnicity, age and the like. Further, the tone, volume and frequency of the outputs may be varied.

It will this be appreciated that the invention, at least in the case of the examples described above, provides stairlift users and/or carers with an easily understandable and immediate means of addressing faults, perceived faults, and problems that might arise during use of the stairlift.

The invention claimed is:

1. A stairlift comprising:

a rail;

a carriage displaceable along said rail;

a user control displaceable by a user to effect movement of said carriage along said rail;

a diagnostic facility configured to detect faults arising in the operation of the stairlift, wherein said diagnostic facility is further configured to identify the nature of a fault and to issue to a stairlift user a voice-based output in response to that fault, wherein said voice-based output comprises an instruction to the user relating to operation of the user control; and an upper stop point at an upper end of the rail and a lower stop point at a lower end of the rail, wherein a fault comprises the carriage coming to a halt between said upper stop point and said lower stop point in response to said user control assuming an off position, and wherein said diagnostic facility is configured to issue the voice-based output comprising an instruction to a user to displace the user control into an operating position to effect movement of said carriage toward a stop point.

2. The stairlift as claimed in claim 1, wherein said voice-based outputs comprise suggestions or instructions to aid a user in responding to a detected fault.

3. The stairlift as claimed in claim 1, wherein said diagnostic facility is configured to delay issuing a voice-based output for a defined period following a detection of a fault.

4. The stairlift as claimed in claim 3, wherein said defined period varies according to the nature of the detected fault.

5. The stairlift as claimed in claim 1, wherein the voice-based output is linked with a further voice-based output, a non-verbal audio output and/or a haptic output.

6. The stairlift as claimed in claim 1, wherein said diagnostic facility is further configured to issue a voice-based output comprising an instruction to a user not to dismount from the stairlift until arrival at a stop point.

7. The stairlift as claimed in claim 6 further comprising a chair occupancy sensor and wherein said diagnostic facility is configured to issue an instruction to a user not to dismount from the stairlift in response to a signal from said chair occupancy sensor.

8. The stairlift as claimed in claim 1, wherein a fault comprises the carriage failing to move or coming to a halt while the user control is in an operating position, and wherein said diagnostic facility is configured to issue a voice-based output comprising an instruction to a user to communicate with a help provider.

9. The stairlift as claimed in claim 8, wherein said diagnostic facility is further configured to issue a voice-based output comprising an instruction to a user of a procedure to dismount from the stairlift.

10. The stairlift as claimed in claim 1, further comprising safety pads displaceable in an event said carriage encounters an obstruction while moving along said rail, wherein a fault comprises the carriage failing to move or coming to a halt while said user control is in an operating position and a safety pad is displaced by contact with an obstruction, and wherein said diagnostic facility is configured to issue a voice-based output comprising an instruction to remove an obstruction to thereby release the safety pad; or to drive the carriage in a reverse direction away from the obstruction.

11. The stairlift as claimed in claim 1, further comprising one or more of a carriage isolation switch, a bi-stable switch and a key switch, each of said switches having an 'on' position and an 'off' position, any of said switches when in an the off position preventing said carriage from movement along the rail, wherein a fault comprises a switch being in an off position while said user control is displaced to an operating position, and wherein said diagnostic facility is configured to issue a voice-based output instructing a user to displace said switch to an 'on' position.

12. The stairlift as claimed in claim 11, wherein said diagnostic facility is further configured to issue a voice-based output directing a user to a location of said switch, the position of which is preventing movement of said carriage.

13. The stairlift as claimed in claim 1, wherein said diagnostic facility includes an input representative of a voltage level of a battery provided to power said carriage along said rail, and wherein a fault comprises said voltage level being below a target voltage level when said user control is in an operating position, said diagnostic facility being configured to issue a voice-based output instructing a user to displace the user control to drive the carriage to a charging point on said rail.

14. The stairlift as claimed in claim 1, further comprising a battery charger operable to charge one or more batteries within said carriage and said diagnostic facility includes an input representative of the operation of said charger, wherein a fault comprises no charging power being sensed when said carriage is parked on a charging point on said rail, and wherein said diagnostic facility is configured to issue a voice-based output instructing a user to check the connection of said charger to mains power.

15. The stairlift as claimed in claim 1, further comprising a swivel mechanism between said chair and said carriage operable to enable said chair to be swivelled between a central travel position and a swivelled position when said carriage is at a said stop point, wherein a fault comprises said user control being displaced into an operating position when said chair is in a position other than the central position, and wherein said diagnostic facility is configured to issue a voice-based output instructing a user to move the chair to the central position.

16. The stairlift as claimed in claim 1, further comprising a seatbelt operable to retain a user in the chair, said seatbelt having a fastened and an unfastened state, wherein a fault comprises said user control being displaced into an operating position while said seat belt is in an unfastened state, wherein said diagnostic facility is configured to issue a voice-based message instructing a user to move the seatbelt into a fastened state.

17. The stairlift as claimed in claim 1, wherein said diagnostic facility is configured to receive communications from a remote communication device including a mobile telephone, tablet or other and to issue voice-based outputs in response to communications from said remote communication device.

18. The stairlift as claimed in claim 1, wherein said diagnostic facility is configured such that the one or more of tone, volume and frequency of voice-based outputs are adapted to the needs or wishes of a user and/or said diagnostic facility is configured to receive operating upgrades from a remote location.

* * * * *